United States Patent [19]

Elder

[11] 4,051,825

[45] Oct. 4, 1977

[54] ENGINE HEATER

[75] Inventor: Hayden O. Elder, Troy, Kans.

[73] Assignee: The Hay-Mar Corporation, Troy, Kans.

[21] Appl. No.: 712,244

[22] Filed: Aug. 6, 1976

[51] Int. Cl.[2] ..... F02N 17/02

[52] U.S. Cl. ..... 123/142.5 R; 237/12.3 B

[58] Field of Search ..... 123/142.5 R; 237/8 R, 237/8 A, 12.3 B, 34, 36

[56] References Cited

U.S. PATENT DOCUMENTS

| | | | |
|---|---|---|---|
| 1,234,049 | 7/1917 | Lovell | 123/142.5 R X |
| 1,974,907 | 9/1934 | Worth | 123/142.5 R X |
| 2,716,400 | 8/1955 | Smith et al. | 123/142.5 R |
| 3,373,728 | 3/1968 | Collins | 123/142.5 R |
| 3,758,031 | 9/1973 | Moran | 123/142.5 R X |
| 3,853,270 | 12/1974 | Prebil | 123/142.5 R X |

*Primary Examiner*—Carroll B. Dority, Jr.
*Assistant Examiner*—Ira S. Lazarus
*Attorney, Agent, or Firm*—Schmidt, Johnson, Hovey & Williams

[57] ABSTRACT

A simplified, yet highly effective, engine heating apparatus and method is provided which facilitates starting of a cold automotive engine by preheating the engine with hot antifreeze from a fluid-cooled service engine temporarily coupled to the cold engine; in this manner, the cold engine can be heated prior to attempts at starting so that damage to the battery, starter or other internal components thereof is eliminated. In preferred forms, the apparatus includes fluid-conveying conduits permanently coupled to the cooling systems of the cold and service engine and normally detachably secured together to define respective closed fluid loops with the associated engines, along with transfer conduits which can be quickly and easily connected through the use of quick-couplers between the disconnected engine conduits to establish fluid communication between the separate engine cooling systems. Running of the hot service engine thus circulates hot antifreeze through the cold engine block and serves to heat the cold antifreeze to permit quick starting of the engine.

4 Claims, 2 Drawing Figures

ENGINE HEATER

Figure 1:
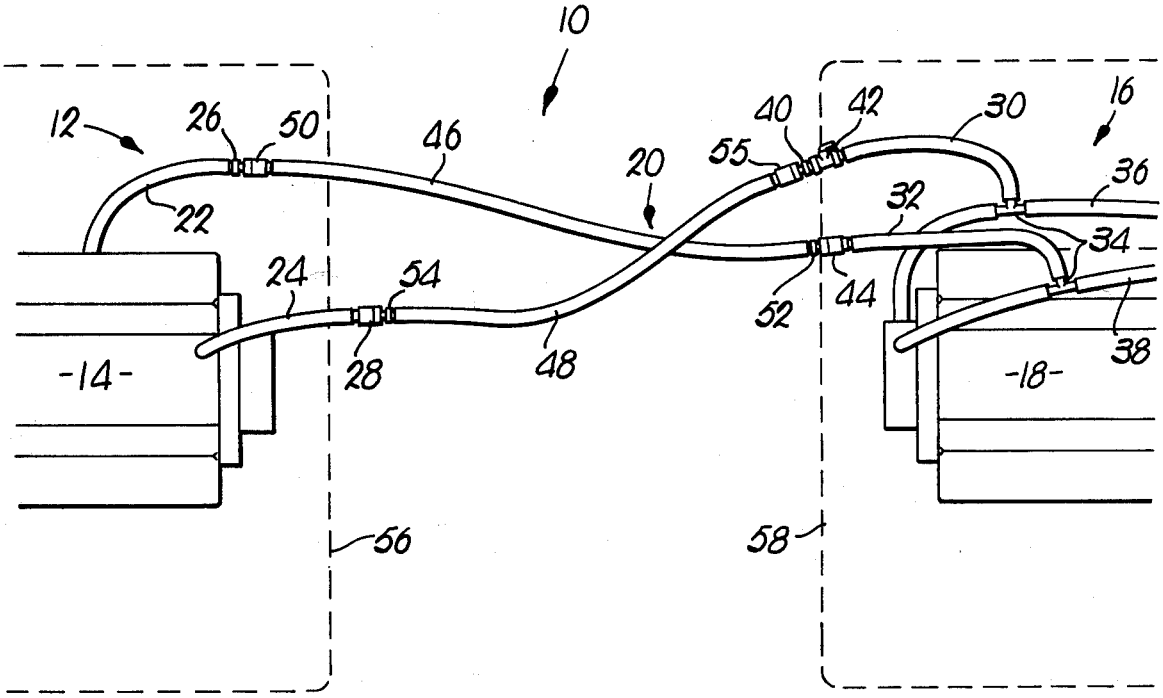

This invention relates to apparatus and method for facilitating cold-weather starting of automotive engines by coupling the fluid cooling system of a cold engine to that of a hot service engine in order that running of the service engine will circulate hot antifreeze through the cold engine block and heat the initially cold antifreeze therein. More particularly, it is concerned with such an apparatus and method which preferably includes a pair of conduit sections permanently coupled to the cold and service engines and normally connected together to define respective closed fluid loops, in conjunction with elongated transfer conduits which can be selectively quick-coupled between the engine conduits to communicate the fluid-cooling systems of the cold and service engines.

As every driver in northern climates knows, cold-weather starting of automotive engines can be extremely troublesome. In many instances, cold-weather starting can involve considerable time and possible damage to engine components, especially the battery and starter. This results from the fact that it is often necessary to operate the motor through the battery and starter for a sufficient period of time to permit actual starting thereof, and this inevitably causes wear and tear on the engine and battery.

The traditional approach in starting a disabled cold engine is to use so-called booster cables which are attached to the battery of the cold engine, and also to that of a service engine. This in effect permits continued operation of the cold engine starter through power supplied by the service engine. Although this in many instances ultimately serves to start the cold engine, it will be appreciated that possible battery and starter damage are in no way alleviated by this technique.

It is therefore the most important object of the present invention to provide apparatus for facilitating the starting of cold, fluid-cooled engines through the use of conduit means coupling the fluid-cooling system of the cold engine with that of a heated service engine so that hot antifreeze from the latter is circulated through the cold engine block and the cold engine antifreeze is simultaneously heated; thus, heating of the cold engine can be accomplished without in any way causing damage to engine components such as the battery or the starter, and without the need of an auxiliary source of electric power, as has been conventional in the past.

As a corollary to the foregoing, another object of the invention is to provide engine heater apparatus which includes respective pairs of fluid-conveying conduits permanently coupled to the cold and service engines and detachably connected together to present respective closed fluid loops with the cooling systems of the associated engines, along with elongated fluid-transfer conduits adapted for detachable connection between the disconnected engine conduits in order to establish fluid communication between the respective fluid-cooling systems.

Finally, another object of the invention is to provide a method of heating a cold, fluid-cooled automotive engine through the use of an automotive service vehicle powered by an engine having a pressurized fluid-cooling system, which includes the steps of moving the service vehicle adjacent the cold engine and interconnecting fluid-transfer conduits between the fluid-cooling systems of the cold and service engines, whereupon the service engine can be run to effect circulation of the heated cooling fluid through the cold engine block and heat the initially cold antifreeze in the cold engine; after sufficient heating has occurred, the transfer conduits can be disconnected and the cold engine started in the usual fashion.

Figure 2:
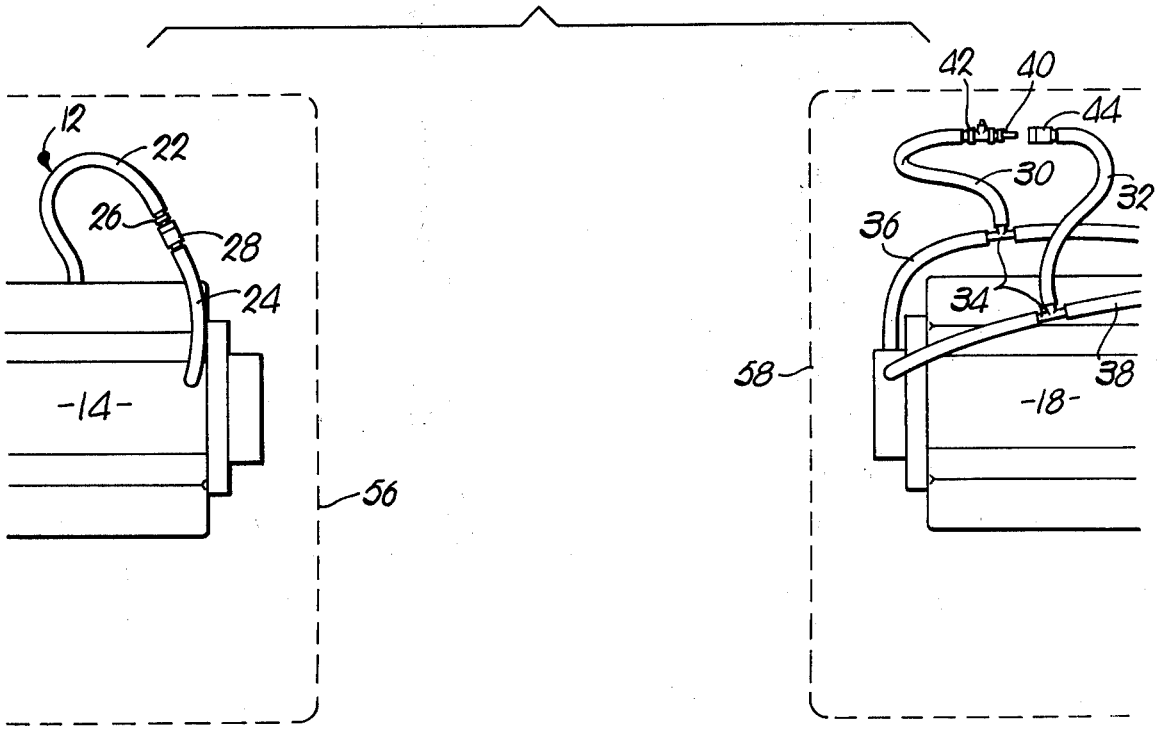

In the drawing:

FIG. 1 is an essentially schematic view illustrating the connection between a cold, fluid-cooled engine and a heated service engine in order to heat the former and facilitate starting thereof; and FIG. 2 is an essentially schematic representation of the respective engines after the elongated fluid-transfer conduits have been disconnected and illustrating the permanently installed fluid-conveying conduits connected to the separate engines.

Turning now to FIG. 1, the engine-heating apparatus 10 of the present invention is illustrated as it would appear during heating of an initially cold automotive engine 12 having a block 14 and a conventional fluid-cooling system. Broadly, apparatus 10 includes a heated automotive service engine 16 having a block 18 and the usual pressurized fluid-cooling system, along with a conduit system broadly referred to by the numeral 20 for interconnecting the fluid-cooling systems of engines 12 and 16.

In more detail, conduit system 20 includes first and second fluid conduit segments 22 and 24 permanently connected to and in communication with the fluid-cooling system of engine 12 through the spool block outlet plug openings. Segment 22 has a male connective element 26 attached to the outermost end thereof, while segment 24 includes a complementary female connective element 28 adjacent its outermost end. First and second fluid-conveying conduit sections 30 and 32 are operatively connected to the pressurized fluid-cooling system of service engine 16. As illustrated in FIG. 1, the respective sections 30 and 32 are each connected to individual T-connectors 34, with each of the latter being interposed in one of the cab heater hoses 36 and 38 conventionally provided with engine 16. A male connective element 40 having a selectively openable valve 42 therein is attached to the outermost end of section 30, while a complemental female connective element 44 is connected to the outer end of section 32.

Conduit system 20 also includes a pair of elongated fluid-tranfer conduits 46 and 48 which are adapted to span and interconnect segments 22 and 24 and sections 30 and 32. Conduit 46 has a female connective element 50 at one end thereof and a male connective element 52 at the remaining end thereof. Similarly, conduit 48 includes a male connective element 54 at one end, and a female connective element 55 at the opposite end thereof.

Referring now to FIG. 2, it will be seen that during the normal use of engine 12, the respective segments 22 and 24 are interconnected through the corresponding connective elements 26 and 28. This serves to present a closed fluid loop with the fluid-cooling system of engine 12, so that the latter can be operated in the usual fashion. However, as best seen through a comparison of FIGS. 1 and 2, the connective elements 26 and 28 can be detached to present open-ended segments.

In a similar fashion, the sections 30 and 32 provided with service engine 16 are, during normal operations, interconnected together through the connective elements 40 and 44. However, during normal running of engine 16, valve 42 is closed in order to prevent flow of antifreeze through the sections 30 and 32, so that efficiency of the cab heater (not shown) connected to the hoses 36 and 38 is not impaired. Again, however, when it is desired to use service engine 16 for heating purposes, it is only necessary to detach the sections 30 and 32 to present open-ended conduits.

In use when it is desired to start the cold engine, it is only necessary to detach permanent segments 22 and 24 and connect the transfer conduits 46 and 48 to the open-ended segments through the quick-couplers provided. The remaining ends of the transfer conduits are in turn similarly connected to the detached sections 30 and 32 in the manner indicated in FIG. 1. At this point, the service engine 16 is started which serves to pump hot antifreeze to block 14 of cold engine 12 in order to heat the latter. In this connection, it will be understood that the closed fluid loop presented by the cooling systems of the engines 12 and 16 and conduit system 20 serves to circulate the hot antifreeze from engine 16 to engine 12, and correspondingly cold antifreeze within engine 12 to engine 16. This has the effect of simultaneously heating engine 12 and also the initially cold antifreeze therein. At a certain point (usually 10 to 15 minutes) all of the antifreeze within the closed, two-engine system is at substantially the same temperature, and the two engines are heated to approximately the same level, or at least to a level in engine 12 permitting easy starting thereof. At this point engine 16 is stopped, and transfer conduits 46 and 48 are detached from the respective permanent fluid-conveying conduits of the engines 12 and 16. The separate pairs of conduits are then reconnected using the quick-couplers provided, thereby allowing starting of engine 12 and restarting of service engine 16.

It will be appreciated that the apparatus of the present invention can be used on a wide variety of automotive motors. For example, an owner of a fleet of cars or trucks can equip the majority of the vehicles with permanent hoses, such as segments 22 and 24, and also equip a number of vehicles as service units with sections 30 and 32 and transfer conduits 46 and 48. Then, during cold weather conditions, a disabled vehicle can be started merely by moving a service vehicle adjacent thereto and following the procedures outlined above. In addition, the apparatus and method of the present invention are applicable to farm machinery, such as tractors or the like, and in fact to essentially any automotive-type engine which has a fluid-cooling system. In the drawing, the respective motors 12 and 16 are shown as housed within schematically-illustrated vehicles 56 and 58, and it is to be understood that essentially any type of vehicle could be used in this context.

Having thus described the invention, what is claimed as new and desired to be secured by Letters Patent is:

1. In combination with a cold, fluid-cooled automotive engine, apparatus for heating said cold engine to facilitate starting thereof, said apparatus comprising:

an automotive service engine having a pressurized fluid-cooling system;

first and second fluid conduit segments permanently connected to and in communication with the fluid cooling system of said cold engine;

coupling means adjacent the outermost ends of said first and second segments for detachably connecting said segments to selectively present a closed fluid loop with said cold engine system, and alternately open-ended conduit segments when said coupling means are detached;

first and second conduit sections permanently connected to and in communication with the fluid cooling system of said service engine;

coupling structures adjacent the outermost ends of said first and second sections for detachably connecting said sections to selectively present a closed fluid loop with said service engine system, and alternately open-ended conduit sections when said coupling structures are detached;

a pair of fluid-transfer conduits of length to span the distance between said conduit segments and sections; and attachment means adjacent the opposed ends of said transfer conduits for detachably connecting one of the transfer conduits between the coupling means of one of said segments and the coupling structure of one of said sections, and for detachably connecting the other of said transfer conduits between the remaining segment coupling means and section coupling structure, when said segments and sections are detached, in order to define a closed fluid loop with the cooling systems of said cold and service engines, whereby, upon running of said service engine with the cooling fluid therein in a heated condition, such heated fluid is circulated throughout the last-mentioned closed fluid loop for heating said cold engine and for facilitating starting thereof.

2. The combination as set forth in claim 1 wherein said sections are each coupled to fluid-conveying T-joints, the latter being operatively connected to the heater hoses of said service engine.

3. The combination as set forth in claim 2 including selectively operable valve structure interposed in one of said sections for selectively preventing fluid flow through the sections when the latter are coupled together.

4. A method of heating a cold, fluid-cooled automotive engine provided with a pair of fluid conduit segments operatively and permanently connected to the fluid-cooling system thereof and having corresponding detachable coupling means adjacent the outermost ends thereof connecting said segments to present a closed fluid loop with the cooling system of said engine, said method comprising the steps of:

moving a mobile service vehicle having a heated service engine with a pressurized fluid-cooling system to a position adjacent said cold automotive engine;

detaching said coupling means to present a pair of elongated, open-ended conduit segments connected to the fluid-cooling system of said cold engine;

connecting said segments to respective fluid transfer conduits operatively connected to the pressurized fluid-cooling system of said service engine to present a closed fluid loop between said cold and service engines;

running said service engine to effect circulation of the heated cooling fluid throughout said closed fluid loop for a sufficient time to heat said cold engine;

disconnecting said segments from said tranfer conduits; and reconnecting said fluid conduit segments.

* * * * *